United States Patent [19]

Wallow

[11] Patent Number: 4,995,573

[45] Date of Patent: Feb. 26, 1991

[54] PROJECTILE EQUIPPED WITH GUIDE FINS

[75] Inventor: Peter Wallow, Langenfeld, Fed. Rep. of Germany

[73] Assignee: Rheinmetall GmbH, Düsseldorf, Fed. Rep. of Germany

[21] Appl. No.: 453,288

[22] Filed: Dec. 22, 1989

[30] Foreign Application Priority Data

Dec. 24, 1988 [DE] Fed. Rep. of Germany ..... 3843796

[51] Int. Cl.[5] ..... F42B 10/08

[52] U.S. Cl. ..... 244/3.24; 102/521

[58] Field of Search ..... 244/3.24, 3.25, 3.27, 244/3.28, 3.29, 3.3; 102/521

[56] References Cited

U.S. PATENT DOCUMENTS

| | | | |
|---|---|---|---|
| 2,979,285 | 4/1961 | Planitzer | 244/3.24 |
| 4,708,304 | 11/1987 | Wedertz et al. | 244/3.26 |
| 4,732,086 | 3/1988 | Schiestl et al. | 244/3.24 |

FOREIGN PATENT DOCUMENTS

| | | | |
|---|---|---|---|
| 3038087 | 5/1982 | Fed. Rep. of Germany . | |
| 853366 | 4/1940 | France | 244/3.24 |

*Primary Examiner*—Michael J. Carone

*Attorney, Agent, or Firm*—Spencer & Frank

[57] ABSTRACT

A projectile has a main body having a smooth end region, an intermediate sleeve over the smooth end region, a guide mechanism sleeve and guide fins. In one embodiment, the intermediate sleeve has an internal surface and an external thread, the intermediate sleeve being soldered at the internal surface to the smooth end region of the main body. The guide mechanism sleeve has an internal thread screwed with the internal thread onto the external thread of the intermediate sleeve at a tail region of the projectile. The guide fins are fixed to the guide mechanism sleeve. In a second embodiment, the projectile includes a longitudinally extending main body having an end region conically tapered toward a front end of the projectile, and a conically tapered intermediate sleeve having longitudinally extending slots, regions of the intermediate sleeve between the slots being radially elastic. The intermediate sleeve is fitted over the tapered end region of the main body so as to clamp the tapered end region. The guide mechanism sleeve which fixes the guide fins at a tail region of the projectile, has a conically tapered inner wall region lying frictionally locked against an outer surface of the intermediate sleeve.

14 Claims, 4 Drawing Sheets

PROJECTILE EQUIPPED WITH GUIDE FINS

BACKGROUND OF THE INVENTION

The present invention relates to a projectile equipped with guide fins, particularly a heavy metal kinetic energy projectile having a large length/diameter ratio, in which the connection of the guide fins with the projectile is effected by means of a guide mechanism sleeve which is fastened to the tail region of the projectile.

Arrow stabilized kinetic energy projectiles are known whose tail region (which may be tapered) forms a support for a guide mechanism. The fins of the guide mechanism are disposed on a cylindrical sleeve.

The sleeve is fastened to the projectile, for example, by means of threads provided at a rear stub on the projectile. This type of connection involves the risk that the guide mechanism breaks off upon firing or upon contact with the target, for example with the first target plate (armor) of a multiple target, together with part of the penetrator, particularly if transverse stresses occur because the target is disposed at an angle. This results in a loss of mass and length of the projectile, adversely affecting its effectiveness.

According to German Patent No. 30 38 087 a thin tubular sleeve supporting the guide fins is connected to the tail region of the projectile by means of solder or glue. Such a connection, however, cannot be used if the stresses derived from the forces and heat under firing are too high (particularly where a glue connection is involved) and if materials are to be connected which cannot be soldered together, such as, for example, tungsten heavy metal and aluminum, tungsten heavy metal and magnesium, and tungsten heavy metal and plastic.

The basic requirements for such a connection are therefore, on the one hand, that it be tight enough that it is able to withstand the stresses of firing and that the guide mechanism will not break off during firing, and on the other hand, that the connection be released no later than upon impact on the target so that the guide mechanism does not impede penetration of the projectile into the target. In this latter connection, the tail region of the projectile, particularly the threaded stub, should be prevented from breaking off due to a notch effect. Finally, the guide mechanism must be as lightweight as possible and have such a small mass that when the guide mechanism and the means for fastening the guide mechanism to the projectile are released the total mass of the projectile body is not or is only slightly reduced, so that the penetration power of the projectile will not be adversely affected.

SUMMARY OF THE INVENTION

It is therefore an object of the invention to provide a connection between the guide mechanism and the projectile body for a fin stabilized projectile of the abovementioned type which does not have the drawbacks of the prior art connections, and which can be used, in particular, for aluminum guide mechanisms, is able to withstand the stresses of firing, and in which the guide mechanism will be easily released from the projectile upon impact on the target without decelerating the projectile or tearing off the rear connection region of the projectile, so that no loss of mass and length of the projectile body occurs during penetration into the target.

In such a projectile in accordance with the invention, an intermediate sleeve of steel, aluminum, solder or the like provided with an external thread is fastened by means of a solder connection to the smooth end region of the projectile and the sleeve of the guide mechanism is provided with an internal thread so that it can be screwed onto the external thread of the intermediate sleeve. In accordance with another aspect of the invention, the disadvantages of the prior art are overcome by a projectile in which an intermediate sleeve equipped with longitudinal slots and having a conical taper, is pushed onto an end region of the projectile which is correspondingly forwardly conically tapered, and a correspondingly conically tapered inner wall region of the sleeve of the guide mechanism lies against the outer wall of the intermediate sleeve by means of a friction lock while the intermediate sleeve is clamped against the rear end region of the projectile.

One significant feature of the invention is a notch-free connection of the guide mechanism without threads or notch effects at the main projectile body itself. A hard solder connection may be employed to connect a light metal guide mechanism to the main projectile body (penetrator), which heretofore has been used only between steel guide mechanisms and tungsten heavy metal projectiles, because light metal guide mechanisms were deemed too sensitive to temperature. Moreover, the easier release of the guide mechanism produces the feature that transverse forces upon oblique impact of the projectile on the target are not transferred to the penetrator, thus avoiding power-reducing angled (oblique) positions of the penetrator during its passage through the target.

BRIEF DESCRIPTION OF THE DRAWINGS

These and other features and advantages of the invention may be more completely understood from the following detailed description of the preferred embodiments of the invention with reference to the accompanying drawings in which.

DESCRIPTION OF THE PREFERRED EMBODIMENTS

Figure 1:
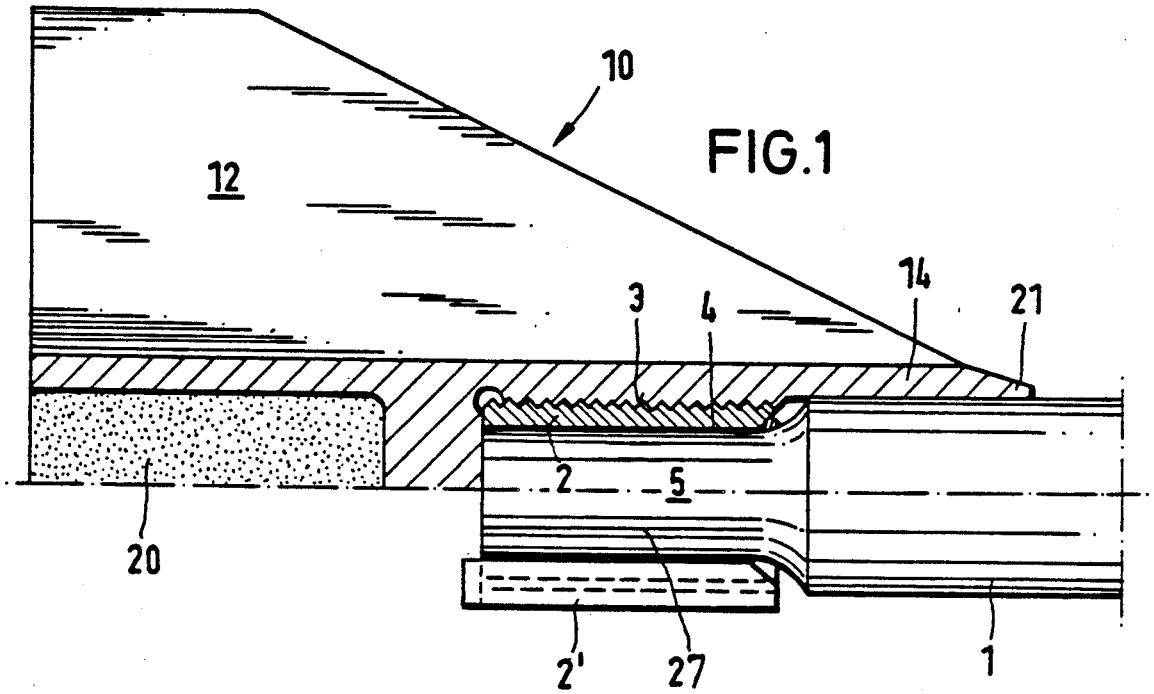
FIG. 1 is a partial side view, partially in section, of a projectile tail section according to a first embodiment of the invention.

According to the embodiment illustrated in FIG. 1, projectile 1 has a main body (penetrator) which includes a rear, offset region (end region) or stub 5. A solder connection 4 connects this region, with an intermediate sleeve 2 which on its exterior is provided with a thread 3 onto which is screwed a sleeve 14 of a guide mechanism 10 made in one piece with fins 12. The lower region of FIG. 1 shows a cylindrical workpiece 2' prior to being soldered to the end region 5 and worked to form the intermediate sleeve 2. In order to center the sleeve, spacers, e.g. wires having a diameter corresponding to that of the respective soldering gap, may be applied longitudinally to end region 5 before pouring solder into the space between cylindrical workpiece 2' and end region 5. Moreover, the interior face 21 of sleeve 14 which surrounds projectile 1 also serves as a centering surface.

Guide mechanism 10 is fastened to end region 5 of projectile 1 in the following manner:

The cylindrical workpiece 2', which is preferably made of steel and is overdimensioned, is pushed over the end region 5 so a to be coaxial therewith. End region 5 has the form of an unnotched end stub and may have spacers for purposes of centering. Next, the liquid solder is filled in between end region 5 and workpiece 2', and allowed to harden. Then, the workpiece 2' is machined to its desired dimension, i.e. to the outer diameter of the thread, and an external thread 3 is cut into it to form the intermediate sleeve 2. Now sleeve 14 of guide mechanism 10 can be screwed onto end region 5. Sleeve 14 is provided with a recess to accommodate a tracer set 20.

If spacers are provided, they are preferably at least three thin wires 27 uniformly distributed over a circumferential surface of the end region 5, the wires extending approximately parallel to the axis of the projectile. With the spacers provided, the intermediate sleeve 3 is pushed over the spacers so that the intermediate sleeve and the end region are coaxial. Then liquid solder is poured into a space between the intermediate sleeve and the end region. After the solder hardens, the exterior of the intermediate sleeve is machined and a thread is cut in its outer surface.

Figure 5:
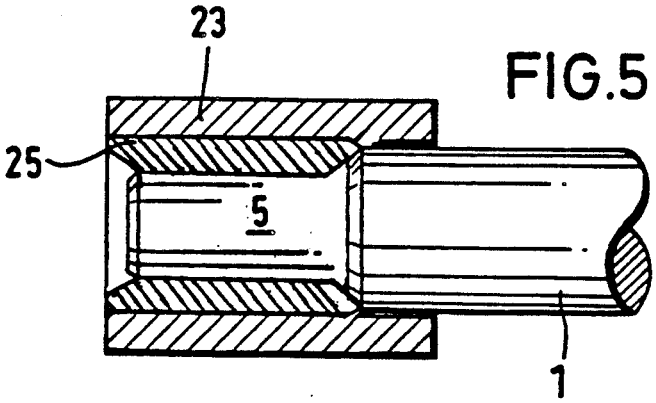
FIG. 5 is a partial side view, partially in section, of a mold for an intermediate sleeve according to a fourth embodiment of the invention.

Another possibility is that the intermediate sleeve is formed of hardened solder which is totally machined and the thread is cut into the hardened solder, so that the end region 5 of the projectile 1 (penetrator of for example tungsten heavy metal which is highly subject to breaking, particularly if transverse stresses occur) is free of notches or slots (see FIG. 5). This design makes possible a solder layer of uniform strength; thus eliminating tilting of the shell-shaped casting mold 23 described below. As a result, the reproducibility of a sufficient firing force capacity of this connection is guaranteed. The wires 27 used as spacers (for example, piano chords) must correspond in thickness to the required solder slot.

Since the guide mechanism is mounted to the end region of the main body via an intermediate sleeve which is soldered to the end region, the guide mechanism can be formed of materials which cannot be directly soldered to the material of the main body. For example, if the main body is formed of tungsten heavy metal, use of the intermediate sleeve permits the guide mechanism to be formed of such lightweight alloys as those containing aluminum and/or lithium and/or magnesium.

As soon as the projectile penetrates a first target plate (armor), the front edge of sleeve 14 hits the target plate. Due to the solder connection 4 between the guide mechanism and the smooth end region 5, sleeve 14 is easily stripped away from end region 5. There exists no risk that the end region 5 in the form of a stub, or even a larger piece of the penetrator, might break off and thus substantially reduce the mass and the kinetic energy of the projectile. Also, in the event that the penetrator strikes a target plate which is disposed at an oblique angle, transverse forces which would cause the penetrator to adopt a power reducing oblique position, are not transferred from the guide mechanism to the penetrator.

Thus, this measure makes it possible that the soldered connection (shear surface) is laid out in such a way that it can only withstand the firing forces—including the respective reserves. By contrast, the connection of the guide mechanism with the projectile body is severed at higher stresses such as they occur during impact of the guide mechanism at the target. Should a transverse moment be generated by means of the guide mechanism to the penetrator tail portion (including e.g. stub 5) during impact on an oblique target, before the stripping away of the tail portion starts, the most that can be expected is a slight distortion of the penetrator tail portion. The breaking off of the penetrator tail portion which is commonly observed in conventional fin guide fastenings—caused by the extreme notch sensitivity of a penetrator tail element made of tungsten heavy metal having a threaded bore—is avoided.

Figure 2:
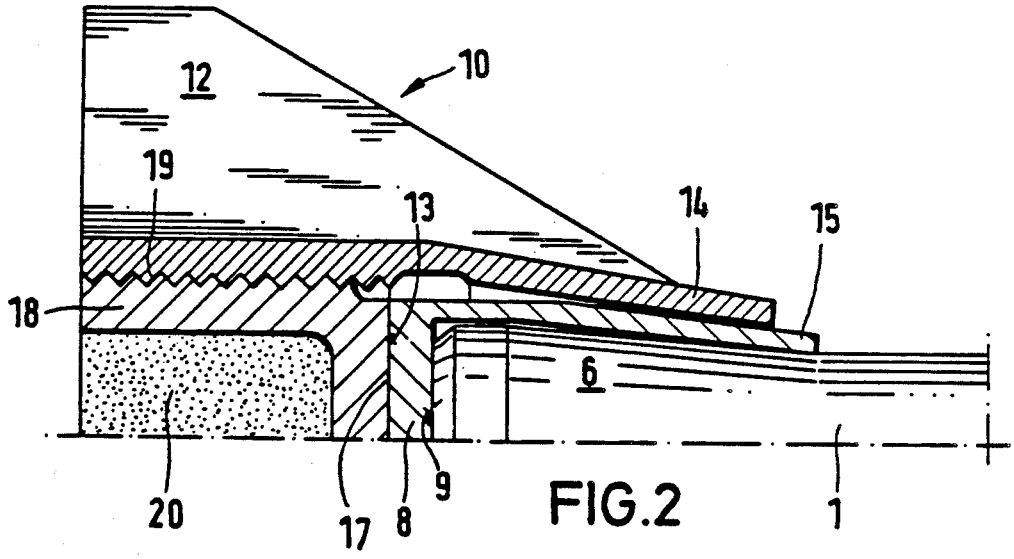
FIG. 2 is a partial side view, partially in section, of a projectile tail section according to a second embodiment of the invention.
Figure 3A:
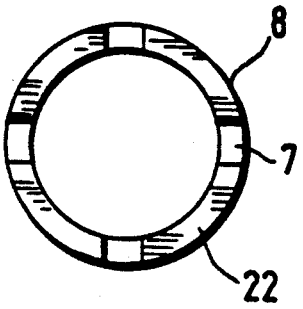
FIGS. 3 and 3A are respectively a side view partially in section, and an end view of an intermediate sleeve.
Figure 3:
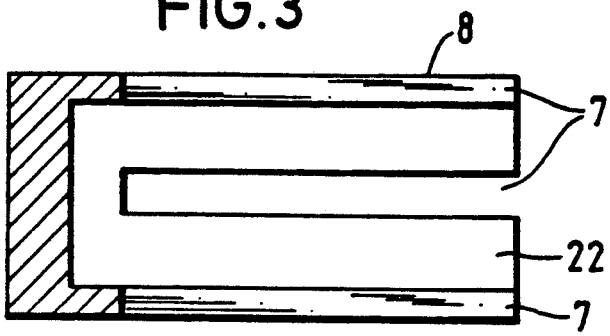

According to the embodiment illustrated in FIG. 2, the end region 6 of projectile 1 is tapered toward the front. Clamped over it is an intermediate sleeve 8, preferably made of a light metal such as aluminum. As shown in FIGS. 3 and 3A, sleeve 8 is provided with longitudinal slots 7 between wall portions 22. The sleeve 8 is conically tapered, radially elastic and dimensioned so as to clamp onto the end region 6. The interior bottom of sleeve 8 lies against the tail face 9 of end region 6 of the projectile. The sleeve 14 of guide mechanism 10 is pushed over intermediate sleeve 8 and is pulled rearwardly by a screw 18 whose frontal face 13 is supported at the exterior bottom 17 of sleeve 8 so that a clamping connection is formed between sleeve 14 and intermediate sleeve 8. Screw 18 is provided with a cavity to serve as a container to accommodate a tracer set 20.

The connections between the individual components are effected as follows:

First, the guide mechanism 10 and sleeve 14 are pushed forward over end region 6 beyond a desired end position. Then intermediate sleeve 8 is pushed from the left in FIG. 2 onto end region 6 through the hollow portion of sleeve 14, with sleeve components 2 being able to elastically widen between slots 7. Then screw 18 is used to pull sleeve 14, by way of thread 19, into its rearward end position so that a clamped connection is effected, with the front end 15 of sleeve 8 possibly projecting somewhat beyond the front end of sleeve 14.

As soon as the projectile impacts on a target plate, the thin wall portions 22 of sleeve 8 are deformed and thus cause sleeve 14 of the guide mechanism 10 to burst open so that both sleeves are rearwardly stripped off from end region 6.

Figure 6:
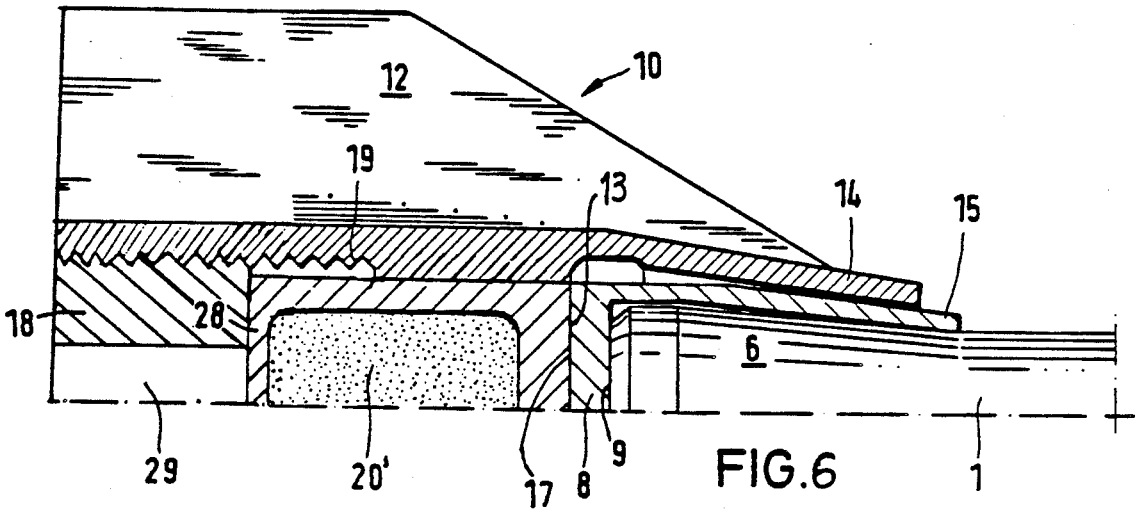
FIG. 6 is a partial side view, partially in section, of a projectile tail section according to a fifth embodiment of the invention.

Instead of integrally forming the screw 18 with a container for a tracer set 20 so that the screw 18 abuts and is directly supported by the end face 17 of the intermediate sleeve 8 as illustrated in FIG. 2, a container 28 having a recess for a tracer set 20' may be provided separately and pushed into the guide mechanism sleeve 14 ahead of a screw 18' having a central bore 29 for ignition of the tracer set 20', and the guide mechanism sleeve 14 retracted with the screw 18' in the rear end of the guide mechanism sleeve 14, as illustrated in FIG. 6.

Figure 4:
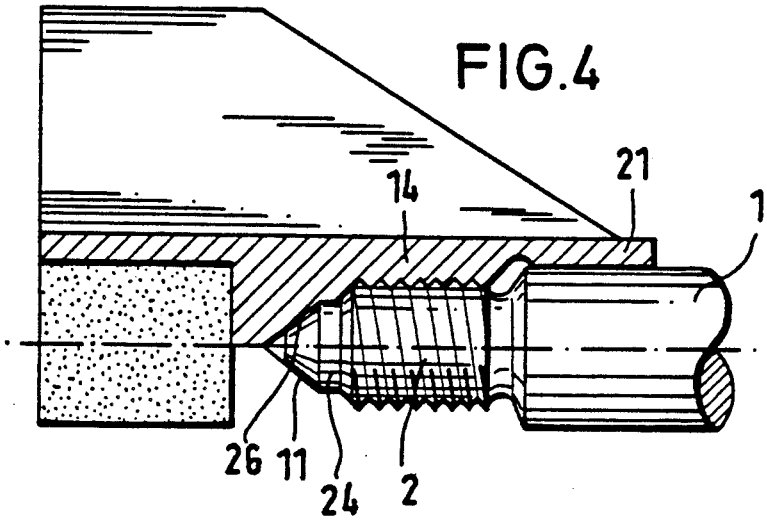
FIG. 4 is a partial side view, partially in section, of a projectile tail section according to a third embodiment of the invention.

FIG. 4 corresponds to the embodiment of FIG. 1 except that here the end region 24 of the projectile is provided with a front centering face 11 which has a slope corresponding to the sloped interior face 26 of sleeve 14 and which cooperates with the frontal interior face 21 of sleeve 14 surrounding the projectile, to center the sleeve 14.

FIG. 5 shows the casting mold 23 spaced around the notch-free or smooth end region 5 of projectile I and a solder layer 25 which is inserted and melted into the annular space therebetween. After removal of the casting mold as by turning on a lathe this solder layer 25 is machined and provided with an external thread to thus form intermediate sleeve 2 for fastening to the sleeve 14 of the guide mechanism 10.

Figure 7:
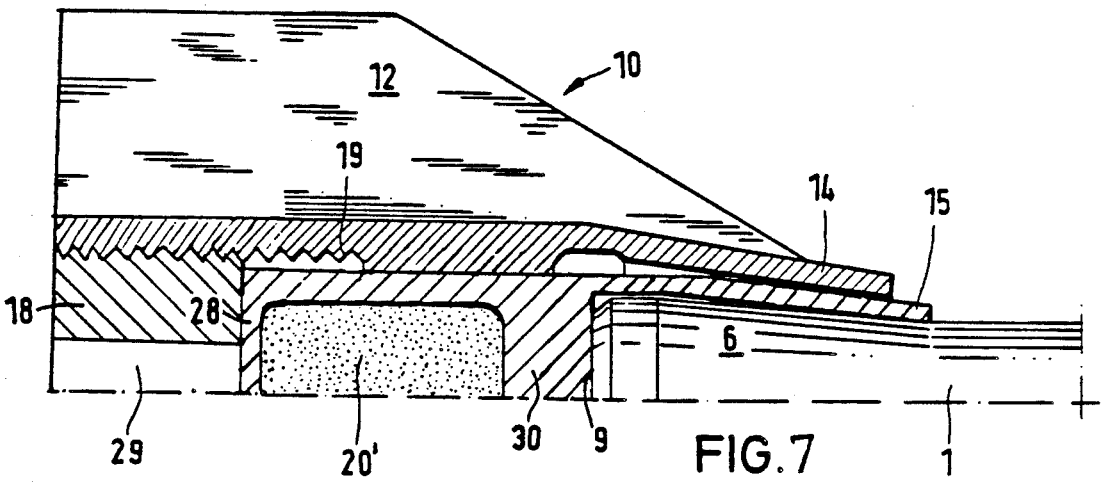
FIG. 7 is a partial side view, partially in section, of a projectile tail section according to a sixth embodiment of the invention.

FIG. 7 shows a further embodiment of the invention. Here an intermediate casing 30 is designed in one piece with an integral tracer container (compare to the embodiment of FIG. 6 in which the intermediate casing 8 and tracer container 28 are separate elements). The front of the intermediate casing 30 is configured like the intermediate casing 8 as shown in FIG. 3. The rear of the intermediate casing 30 comprises a recess for receiving the tracer set 20'. During firing, the tracer set 20' is ignited by means of the central bore 29 and can burn off via this bore and visibly mark the flight path of th projectile.

During mounting of the guide mechanism the guide mechanism sleeve 14 is loosely placed on the end region 6 of the projectile body 1. Then the intermediate case 30 is inserted from behind and braced by means of the rearward screw 18', which engages the interior thread 19 of the guide mechanism sleeve 14. This one-piece embodiment of the intermediate casing 30 makes the cutting of costs in the production of this component possible.

It will be understood that the above description of the present invention is susceptible to various modifications, changes and adaptations, and the same are intended to be comprehended within the meaning and range of equivalents of the appended claims.

What is claimed is:

1. A projectile, comprising:

a main body having a smooth end region;

an intermediate sleeve positioned over said smooth end region, said intermediate sleeve having an internal surface and an external thread, said intermediate sleeve being soldered at said internal surface to said smooth end region;

a guide mechanism sleeve at a tail region of the projectile, having an internal thread screwed with said internal thread onto said external thread of said intermediate sleeve; and guide fins fixed to said guide mechanism sleeve.

2. A projectile as in claim 1, wherein and the projectile is a kinetic energy projectile having a large length to diameter ratio.

3. A projectile as in claim 2, wherein said main body is formed of tungsten heavy metal.

4. A projectile as in claim 1, wherein said end region has a radially inwardly sloped rear end forming a conical centering face, an inner surface region of said guide mechanism sleeve lying against said conical centering face and having a slope corresponding to the slope of said conical centering face.

5. A projectile as in claim 1, wherein said intermediate sleeve is formed of a material selected from the group of materials consisting of steel, solder and aluminum.

6. A projectile as in claim 1, wherein the guide mechanism sleeve is formed of an alloy containing at least one metal selected from the group of metals consisting of magnesium, aluminum, and lithium.

7. A projectile, comprising:

a longitudinally extending main body having a front end and an end region, the end region being conically tapered toward the front end;

a conically tapered intermediate sleeve having longitudinally extending slots, regions of said intermediate sleeve between said slots being radially elastic, said intermediate sleeve being fitted over said tapered end region so as to clamp said tapered end region;

a guide mechanism sleeve at a tail region of the projectile, having a conically tapered inner wall region lying frictionally locked against an outer surface of said intermediate sleeve; and guide fins fixed to said guide mechanism sleeve.

8. A projectile as in claim 7, wherein the projectile is a kinetic energy projectile having a large length to diameter ratio.

9. A projectile as in claim 8, wherein said main body is formed of tungsten heavy metal.

10. A projectile as in claim 7, further comprising a screw in the tail region fixing said guide mechanism sleeve, said screw having means for accomodating a tracer set.

11. A method of connecting parts of a projectiile which includes: a longitudinally extending main body having a front end and an end region, the end region tapering conically toward the front end; a conically tapered intermediate sleeve having longitudinally extending slots; regions of the intermediate sleeve between the slots being radially elastic, the intermediate sleeve being fitted over the tapered end region so as to clamp the tapered end region, a guide mechanism sleeve at a tail region of the projectile, having a conically tapered inner wall region lying frictionally locked against an outer surface of the intermediate sleeve; and guide fins fixed to the guide mechanism sleeve, the method comprising the steps of:

pushing the guide mechanism sleeve in a forward direction onto a rear end of the tapered end region, beyond a final position;

then pushing the intermediate sleeve through the guide mechanism sleeve onto the end region; and then retracting the guide mechanism sleeve with a screw to the final position, while directly or indirectly supporting the screw with a longitudinally rearward end of the intermediate sleeve.

12. A method as in claim 11, wherein said step of retracting includes the step of pushing a tracer set container into the guide mechanism sleeve and retracting the guide mechanism sleeve with a screw in the rear end of the guide mechanism sleeve.

13. A method of attaching parts of a projectile, the projectile having a penetrator axis and including a main body having a smooth end region, an intermediate sleeve over the smooth end region, the intermediate sleeve having an internal surface and an external thread, the intermediate sleeve being soldered at the internal surface to the smooth end region, a guide mechanism sleeve at a tail region of the projectile, having an internal thread screwed with the internal thread onto the external thread of the intermediate sleeve, and guide fins fixed to the guide mechanism sleeve, the end region being symmetric with respect to the axis, the method comprising the steps of:

uniformly distributing spacers in the form of at least three thin wires, over a circumferential surface of the end region, the wires extending approximately parallel to the axis;

then pushing the intermediate sleeve over the spacers so that the intermediate sleeve and the end region are coaxial;

then directing liquid solder into a space between the intermediate sleeve and the end region; and then machining the exterior of the intermediate sleeve and cutting a thread in its outer surface.

14. A method of forming an intermediate sleeve of a projectile, the projectile having a penetrator axis and including a main body having an offset smooth end region, the intermediate sleeve over the smooth end region, the intermediate sleeve having an internal surface and an external thread, the intermediate sleeve being soldered at the internal surface to the smooth end region, a guide mechanism sleeve at a tail region of the projectile, having an internal thread screwed with the internal thread onto the external thread of the intermediate sleeve, and guide fins fixed to the guide mechanism sleeve, the method comprising the steps of:

disposing a casting mold having an inner diameter which corresponds to an outer diameter of the main body, around the offset end region;

then directing liquid solder into a cylindrical space between the offset end region and the casting mold to fill the space with the liquid solder;

then soldifying the solder in a cylindrical shape in the cylindrical space;

thereafter removing the casting mold; and then machining the exterior of the solidified cylindrically shaped solder and cutting a thread in its outer surface to form the intermediate sleeve.

* * * * *